US011410501B2

(12) United States Patent
Choffray et al.

(10) Patent No.: US 11,410,501 B2
(45) Date of Patent: Aug. 9, 2022

(54) CUMULATIVE PERSONAL GUARANTEED JACKPOT FOR GAMING

(71) Applicants: Jean-Christophe Choffray, Neupré (BE); Christophe Boniver, Beaufays (BE); Sylvain Boniver, Beaufays (BE)

(72) Inventors: Jean-Christophe Choffray, Neupré (BE); Christophe Boniver, Beaufays (BE); Sylvain Boniver, Beaufays (BE)

( * ) Notice: Subject to any disclaimer, the term of this patent is extended or adjusted under 35 U.S.C. 154(b) by 70 days.

(21) Appl. No.: 16/268,451

(22) Filed: Feb. 5, 2019

(65) Prior Publication Data

US 2019/0244479 A1 Aug. 8, 2019

Related U.S. Application Data

(60) Provisional application No. 62/627,206, filed on Feb. 7, 2018.

(51) Int. Cl.
*G07F 17/32* (2006.01)

(52) U.S. Cl.
CPC ..... *G07F 17/3258* (2013.01)

(58) Field of Classification Search
None
See application file for complete search history.

(56) References Cited

U.S. PATENT DOCUMENTS

2003/0228899 A1* 12/2003 Evans ..... G07F 17/32 463/25
2006/0030403 A1* 2/2006 Lafky ..... G07F 17/3239 463/27
2006/0052160 A1* 3/2006 Saffari ..... G07F 17/3211 463/27
2006/0183538 A1* 8/2006 Michaelson ..... G06Q 40/04 463/27
2009/0111561 A1* 4/2009 Dewaal ..... G07F 17/32 463/20
2010/0093421 A1* 4/2010 Nyman ..... G06Q 20/108 463/17
2010/0240447 A1* 9/2010 Chan ..... G07F 17/32 463/26
2012/0100902 A1* 4/2012 Moshal ..... G07F 17/3225 463/13
2013/0252723 A1* 9/2013 Nicely ..... G07F 17/32 463/27
2013/0273994 A1* 10/2013 Cobb ..... A63F 13/828 463/18
2016/0155296 A1* 6/2016 Baron ..... G07F 17/322 463/25
2018/0040191 A1* 2/2018 Tran ..... G07F 17/3267

* cited by examiner

*Primary Examiner* — Jason T Yen
(74) *Attorney, Agent, or Firm* — J. Mason Boswell; Boswell IP Law

(57) ABSTRACT

A gaming reward system is described that guarantees a jackpot to a game player. The jackpot is cumulative and based upon the amount paid in by the player over time to play the game. Each time the player plays, the system adds a small amount of the player's wager to the player's jackpot. Over time, the jackpot grows larger. At some point, a triggering event occurs, and the player is awarded the cumulative, guaranteed jackpot. The jackpot is cumulative in the sense that its amount is increased with each play by the player and guaranteed in the sense that the system works to make sure only the specific player who fills the jackpot can win the jackpot.

19 Claims, 3 Drawing Sheets

CUMULATIVE PERSONAL GUARANTEED JACKPOT FOR GAMING

CROSS-REFERENCE TO RELATED APPLICATIONS

This application claims the benefit of U.S. Provisional Patent Application No. 62/627,206 entitled "Cumulative Guaranteed Jackpot for Gaming," and filed on 2018 Feb. 7, which is hereby incorporated by reference.

BACKGROUND

There are many types of games with jackpots that can be won, for example lotteries, bingos, tombola, and slot machines. They all have something in common; each is a game of chance where the winner is selected randomly. The traditional example, the lottery, involves players buying a cheap ticket to be eligible to win a large amount. Only one ticket (or very few tickets) will hit the jackpot, based on pre-established rules. Lotteries depend on a large number of players buying tickets, so that the prize can be attractively large. For a slot machine, players buy a game at a time to display randomly-generated symbols. The interest resides in getting a chance of getting a prize through a combination of symbols. The machine will pay out a lot of small prizes to a lot of players. The mathematical design determines a winning percentage less than 100% (e.g., regarding the legal jurisdiction's gaming rules).

Casino games are typically based on a redistribution rate to the player (RTP) varying from 80 to 99%. RTP is the average expressed as a percentage where the ratio of amount is redistributed randomly to the players regarding their bet. Thus, if a player wagers 10 dollars over time and wins nine dollars, the repayment rate or RTP is 90%. Slot machines found in today's market offer gaming experiences where win-win events are governed by the likelihood of obtaining a match. It can be the common rewards obtained by aligning symbols one after the other (e.g., cherries or other items), a bonus remuneration by obtaining a number of specific bonus symbols, or even getting a jackpot which is a big prize that is hard to get because of low hitting frequency.

To attract players, slot machines have generally big jackpots. The traditional and rare jackpots are made from the contribution of many players but will be won by only one of them. Like the lottery, most of the players lose to allow one lucky player who will hit the jackpot after a time or several games. Jackpots are fed by a small percentage, for example 2 to 4%, of all the bets put in by all of the players. The jackpots can be linked to one machine or across several machines.

Sometimes, a percentage of the redistribution rate is allocated to common game payments, and to bonus games. With each game paid, the mathematical engine of the game relies on its probabilities to determine what the current player has won. A common reward is a reward obtained by a combination of symbols in the basic game. bonus reward is a reward obtained via a special event (e.g., three bonus symbols positioned anywhere in the reels). This event modifies the behavior of the game by adding animations or features that exist only in the context of the bonus. It is mainly during bonuses that the player will be able to proportionally win a lot of money compared to what the player bet. Then, a percentage of the redistribution rate is allocated to jackpot payments. As said previously, this percentage is rather low.

Jackpots work as follows: a small part of the player's bet is virtually placed in a common pot. Once the jackpot is won, the common pot is reset for all the players. Jackpots generally fall once in several thousand or even several million plays, and thus many players will play before any one of them wins the jackpot. The likelihood of a player winning the jackpot is very low. There can be single jackpots or multi-jackpots. All the randomness and frequencies are unique to the game developers, regarding the feeling they want to give the player, as well as the requirements of the game operator for the game to be profitable and engaging.

In each of the above types of gaming, many players will never win a jackpot. This can lead to frustration and a player's loss of interest in the game. This situation can jeopardize the gaming business. Furthermore, most of the slot machines have no purpose other than expecting to get a big prize. This can easily lead to boredom and uncertainty for the player.

DETAILED DESCRIPTION

Cumulative Personal Guaranteed Jackpot

Figure 1:
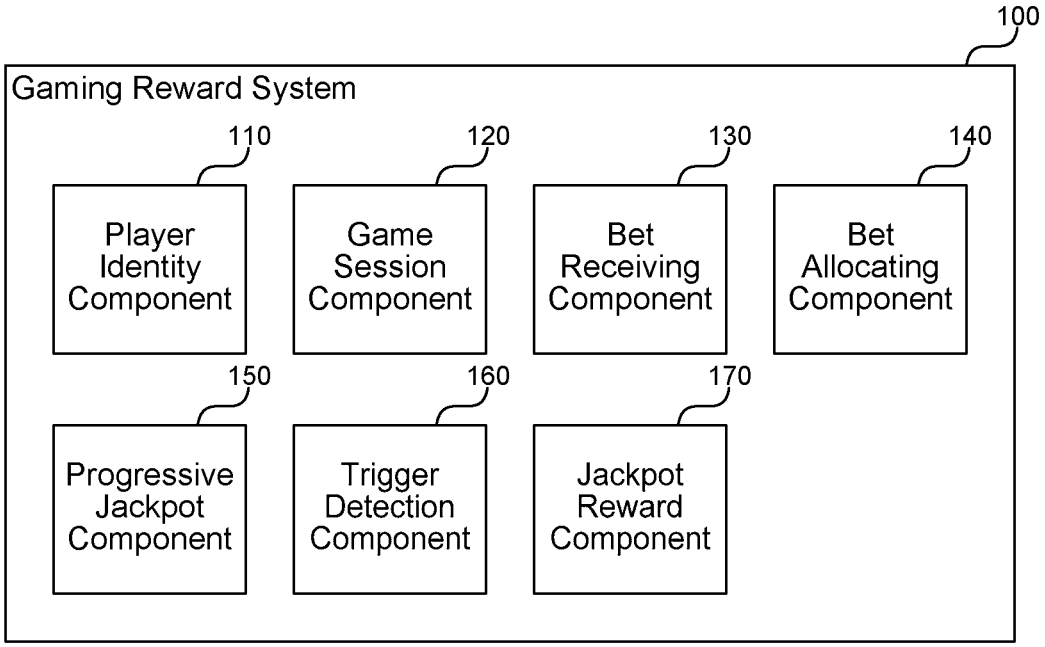
FIG. 1 is a block diagram that illustrates components of the gaming reward system, in one embodiment.

A gaming reward system is described herein that guarantees a jackpot to a game player. Online casino games are usually simple virtual slot machines; casino games offer a "closed" gaming experience where the algorithms control the winnings per game by drawing a combination and winning randomly according to a probability table. What this new type of game offers is a big prize accessible and available to anyone who is ready to take up the challenge. The gaming reward system offers an unprecedented experience in casino games by reducing the chances of seeing players frustrated after playing games for a long time without having won a jackpot, a substantial prize, or not having any reward for accomplishing a long task.

In prior systems, a player who plays a lot of games for a long time has absolutely no certainty of getting those big, attractive prizes. Some players may think that other players are winning what they are owed, for example, a jackpot they are trying to get. With the guaranteed prize of the gaming reward system, the player is certain to get a minimum reward for achieving a specific goal. In some embodiments, achieving the goal is guaranteed in an average time and challenges the player to get the reward.

Another new functionality introduced by the gaming reward system is to have a common pot represented by the percentage (e.g., 92.875%) which is redistributed between all players on the one hand and by the percentage (e.g., 3.125%) placed in a virtual pot for each player independently on the other hand. The system can continue to offer games with random gains shared among all players. However, players will continue to see their own progress in their quest and get closer to their personal reward. In some embodiments, there is no identification between sites. The system retrieves the account information from player "x" on site "y," without links between the different sites.

In some embodiments, the gaming reward system guarantees a jackpot to a player through a token accumulation system. An adaptive reward is set and presented to the player. It is a feature over time, meaning that the player fulfills one main goal to get the adaptive reward. Each time the player buys a new game (e.g., takes a turn), the gaming reward system adds a small percentage of the player's bet to the player's jackpot. There are no betting amount restrictions, the prize adapts itself regarding: the previous accumulated bets and the tokens left to get the reward.

In one embodiment, a player connects to a game, and the system creates a new instance of a personal jackpot for that player. The personal jackpot initially contains a small starting amount of money or no money at all. At some point, a triggering event occurs, and the player is awarded the cumulative, guaranteed jackpot. The jackpot is cumulative in the sense that its amount is increased with each play by the player. The jackpot is guaranteed in the sense that the system ensures the player to win at regular predefined intervals. The system solves the problem of a player playing for a long time without getting any substantial rewards, even if the odds are not in the player's favor for a series of turns.

There can be many types of triggering events that can cause the gaming reward system to award the jackpot to the player. Triggering events can take many forms from giving tokens to award the jackpot. A type of triggering event is the completion of specific in-game goals, such as reaching a new level, collecting a number of symbols, reaching a predefined quest, beating a boss, etc. In addition, one triggering event can simply be the passage of time. If a player has not won due to probability or some other rules, then the system can award (e.g., after 30 minutes) the jackpot to reward the player and giving to him/her the opportunity for continuing to play.

The game guarantees a reward at the end of a linear progression that allows the player to situate him/herself in relation to the promised reward. There is a notion of guarantee by giving achievable and accountable short-term objectives related to the game despite the fact they may be randomly obtained.

In some embodiments, the game and goal can be represented by a long-term adventure. The progression of the player is memorized from one part of the game to another. The player resumes the player's progress every time he/she starts the game. There may be no time limit to the success of this quest. Once the prize has been won, the game may not be over. The player can restart the quest from scratch. Many games can be used with the gaming reward system to increase player engagement, and the system is not intended to be limited herein by any type of game described.

In some embodiments, the game is accessible via mobile device, personal computer, tablet, physical slot machine in a casino, or other devices. The player can start the game in the subway and resume play on the player's tablet once the player has returned home, and during the weekend continue the game from his local casino. In some embodiments, the progress can be linked to a single operator site (for example a local casino) operating the game or the progress can be linked to several sites operating the game (e.g., a local casino and several online casinos). The player will have their own quest for each site or for multiple sites. This depends generally on the operator choice and the regulations in place in the jurisdiction(s) where the game is played.

Gaming Reward System (FIG. 1)

FIG. 1 is a block diagram that illustrates components of the gaming reward system, in one embodiment. The system 100 includes a player identity component 110, game session component 120, bet receiving component 130, bet allocating component 140, progressive jackpot component 150, trigger detection component 160, and jackpot reward component 170. Each of these components is described in further detail herein.

The player identity component 110 identifies a player playing a game. The system 100 may maintain a stored user profile for each player to track the player's progress across multiple game sessions over potentially long periods. For example, each time a player plays over the course of a year, the system 100 may track the player's progress in game sessions each week, so that the system 100 can determine a player's progress at any point in time towards completing a high-level, multi-game goal.

The player identity component 110 may store data, such as contact information for each player (e.g., email, phone, or other information), payment information both for receiving and sending payments, where the player resides (to enforce any jurisdiction-specific game rules), and so forth. The player identity component 110 can identify a player by asking the player to login (e.g., provide a user name and password), by receiving biometric information (e.g., a fingerprint, facial ID, or other identifier), by the player swiping a gaming card, or by other available methods of differentiating one player from another.

The game session component 120 manages an instance of the player playing the game. A session is identified by a location, machine, and period during which the player is playing. A player's engagement and progress with the system 100 may span multiple game sessions. For example, today the player may walk into a casino and progress one of 10 characters through a level on a first machine over the course of an hour, and tomorrow the player may walk into a different casino and progress another character through another level on a second machine over the course of an hour. Each of these two days of playing is one game session.

A game session starts when the player accesses a machine associated with the system 100 and the system 100 identifies the player as a known user of the system 100. The game session ends when the player indicates that he quit the game. The player may have completed a level, be done for the day, be moving to a different location or machine, or be tired of pursuing one goal and wants to make progress on a different available goal. The player may have multiple game sessions per day.

The bet receiving component 130 receives a wager for each bought game. The bet may be variable depending on the player's own estimation of likely success for his/her next game (e.g., the player may bet one dollar on some turns and five dollars on others). Bets may come from the player's cash or may come from one or more accounts stored in the player's profile managed by the player identity component 110 (e.g., a credit card or checking account).

The bet allocating component 140 divides the received wager into operator profit, small winning amounts for the player, and cumulative guaranteed personal jackpot amounts. The small winning amounts are what are redistributed to players during the regular game without a jackpot. In a traditional casino slot machine, this is around 90-plus percentage and shared between all players playing at a same machine. The cumulative guaranteed personal jackpot is the progressive type of jackpot added by the gaming reward system 100 and described herein. The cumulative guaranteed personal jackpot is the amount linked to the player and represents the big reward to get. The operator profit is the amount of money that the operator of the game or game machine receives for offering the game to players. The amount allocated to each of these may be determined by the game operator, by local gaming laws, or by other authorities and/or business priorities.

The progressive jackpot component 150 represents the personal jackpot amounts accumulated by a single player. The progressive jackpot is built on an amount of each play allocated by the bet allocating component 140.

The trigger detection component 160 detects a triggering event for distributing the personal jackpot to the player. The triggering event is definable per game and may be caused by passage of a threshold amount of time, progress toward sub-goals in the game, lack of wins over a period, detection of player disinterest, or any other signal. Upon detecting the triggering event, the trigger detection component 160 invokes the jackpot reward component 170 to provide the personal jackpot to the player.

The jackpot reward component 170 distributes a jackpot to the player. The jackpot may be the long-term or cumulative guaranteed personal jackpot described above. The component 170 may distribute the jackpot by directly dispensing the money to the player (e.g., in the form of coins or casino chips) or by crediting an account associated with the player (e.g., a checking account or casino account). The component 170 may also render a software-based animation to signal the player that the jackpot has been won and to provide a level of excitement to the event of winning the jackpot (e.g., fireworks on screen, audible alarm). The jackpot reward component 170 may also reset the progressive jackpot or other jackpots to allow them to accumulate anew for the next earned reward by the player.

The computing device on which the gaming reward system is implemented may include a central processing unit, memory, input devices (e.g., keyboard and pointing devices), output devices (e.g., display devices), and storage devices (e.g., disk drives or other non-volatile storage media).

The memory and storage devices are computer-readable storage media that may be encoded with computer-executable instructions (e.g., software) that implement or enable the system. In addition, the data structures and message structures may be stored on computer-readable storage media. Any computer-readable media claimed herein include only those media falling within statutorily patentable categories.

The system may also include one or more communication links over which data can be transmitted. Various communication links may be used, such as the Internet, a local area network, a wide area network, a point-to-point dial-up connection, a cell phone network, and so on.

Embodiments of the system may be implemented in various operating environments that include personal computers, server computers, handheld or laptop devices, multiprocessor systems, microprocessor-based systems, programmable consumer electronics, digital cameras, network PCs, minicomputers, mainframe computers, distributed computing environments that include any of the above systems or devices, set top boxes, systems on a chip (SOCs), and so on.

The computer systems may be cell phones, personal digital assistants, smart phones, tablets, personal computers, programmable consumer electronics, digital cameras, and so on.

The system may be described in the general context of computer-executable instructions, such as program modules, executed by one or more computers or other devices. Generally, program modules include routines, programs, objects, components, data structures, and so on that perform tasks or implement abstract data types. Typically, the functionality of the program modules may be combined or distributed as desired in various embodiments.

Figure 2:
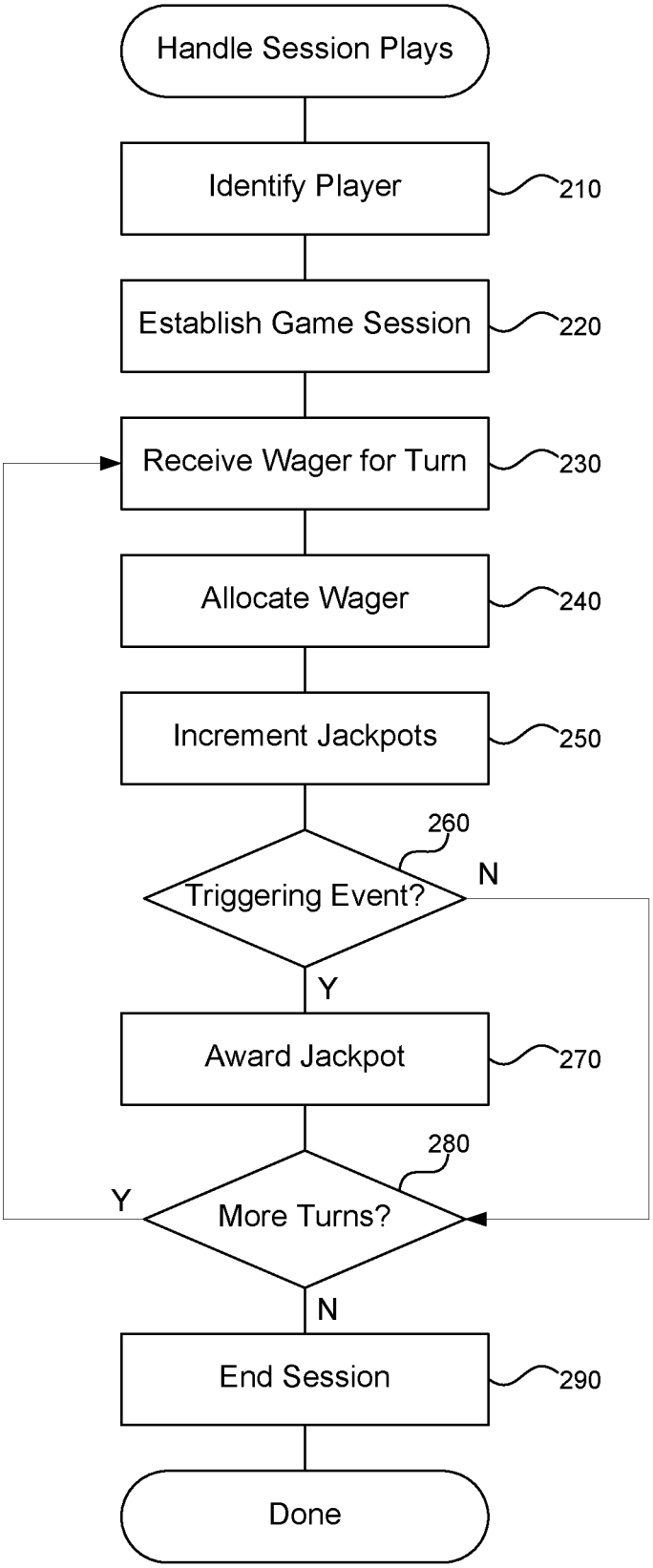
FIG. 2 is a flow diagram that illustrates processing of the gaming reward system to handle one or more plays in the context of a game session associated with a player, in one embodiment.

Handle Session Plays (FIG. 2)

FIG. 2 is a flow diagram that illustrates processing of the gaming reward system to handle one or more plays in the context of a game session associated with a player, in one embodiment.

Beginning in block 210, the system identifies the player playing the game. The system may identify the player by receiving login or other information that identifies the player and allows the system to access an associated player profile with information stored about the player across multiple game sessions. For example, the player may provide an email address and password, swipe a game playing card at a game machine, or provide biometric information such as a facial ID or fingerprint to identify the player to the system. The system identifies the player to allow tracking of the player's progress across multiple game sessions. Thus, the system allows the player to work towards multiple long-term goals. For example, the player may work to progress multiple characters each through multiple levels of the game, earning prizes as each level is completed and at other milestones.

Continuing in block 220, the system establishes a game session that begins as the player starts playing the game at a current location on a current game machine and ends as the player indicates the game session is over. The game session may end by the player logging off the game machine, after a period of inactivity by the player, by logging on at another machine, or by the passage of a threshold period. A game session defines one related period of game play, and a single game may span multiple game sessions.

Continuing in block 230, the system receives a wager from the player preparing the result to send to the player. The wager may be received as cash, chips, or may be automatically deducted from an associated account. The system may calculate and track an average wager amount for multiple turns during the game session.

Continuing in block 240, the system allocates an amount from the received wager to operator profit, small winning amounts for the player, and a cumulative guaranteed personal jackpot.

Continuing in block 250, the system increments the cumulative guaranteed personal jackpot based on the amount allocated to the jackpot. This jackpot accumulates until the conditions for distribution occurs. These conditions may be defined by the game design, game operator, or other authorities. The system may display a current value for the jackpot so that the player knows how much he can potentially win if the conditions are met.

Continuing in decision block 260, if the system detects that a triggering event has occurred, then the system continues at block 270 to award a personal jackpot, else the system continues at block 280. The system may detect these events by watching game progress, receiving a request to end the game by the player, or other signals.

Continuing in block 270, the system awards the cumulative guaranteed personal jackpot to the player from the wagers percentage allocated across multiple turns.

Continuing in decision block 280, if the game design allows to continue the game session, the system loops to block 230 to receive a new wager. It is also the moment where jackpot reward component resets the jackpot to a coherent state. Else the system continues at block 290.

Continuing in block 290, the system determines that the game has reached an end and ends the current game session. The game may end because the player closes temporarily his/her game session (e.g., stopping for today), because the player reaches a game goal (e.g., ending a level), or because of other conditions defined to end the game session. The system may also rollover any remaining jackpot amount into future game sessions played by the player. After block 290, these steps conclude.

Figure 3:
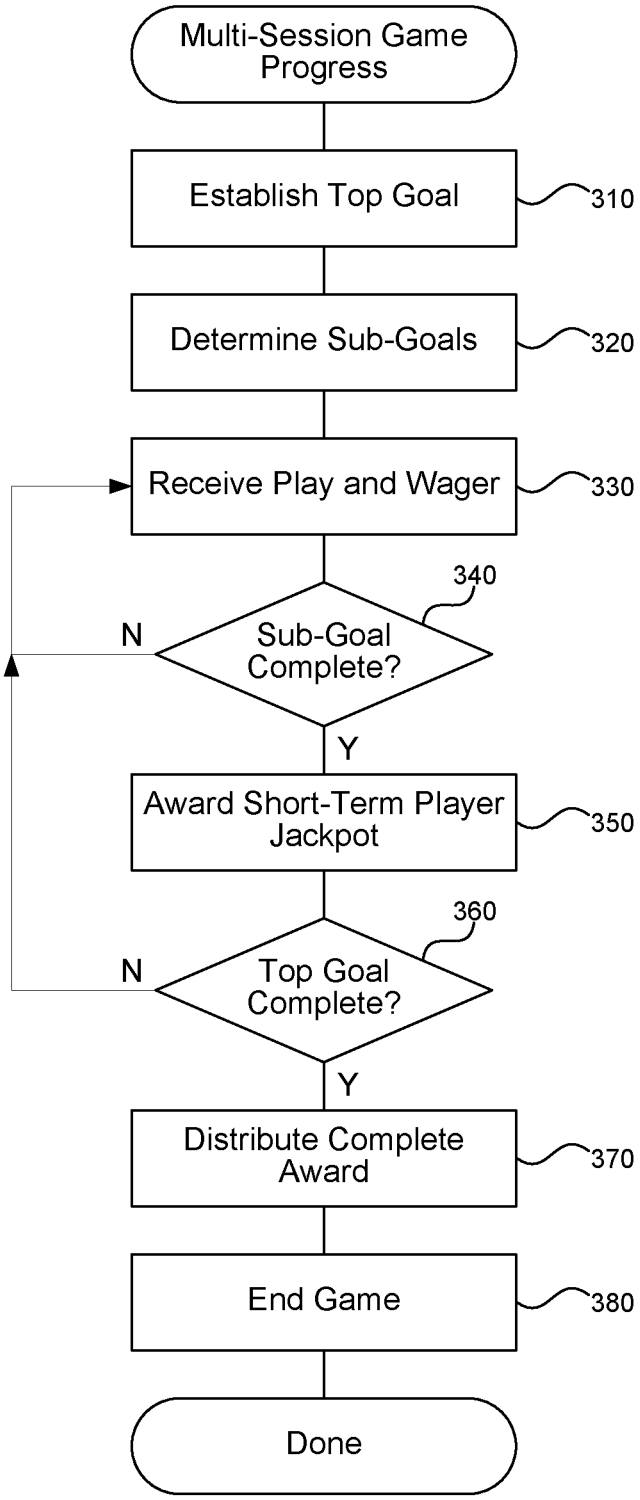
FIG. 3 is a flow diagram that illustrates processing of the gaming reward system to handle multi-session game progress, in one embodiment.

Multi-Session Game Progress (FIG. 3)

FIG. 3 is a flow diagram that illustrates processing of the gaming reward system to handle multi-session game progress, in one embodiment.

Beginning in block 310, the system establishes a top goal that defines completion of a game across multiple game sessions. The top goal may be completing multiple levels as one or more game characters. When a player starts the game, the top goal is presented as something the player will work towards over time.

Continuing in block 320, the system determines one or more sub-goals that are progress points on the way to completing the established top goal. A sub-goal may be completing a level, defeating a boss, earning a threshold number of tokens, finishing an adventure with a character, or any other game design point of progress.

Continuing in block 330, the system receives a play that includes the chosen wager.

Continuing in decision block 340, if the system determines that a sub-goal is complete, then the system continues at block 350, else the system loops to block 330 to receive more plays and wagers. Completing a sub-goal may include defeating a boss, achieving goals, receiving a threshold number of points, or simply playing for a threshold period without receiving a reward. This allows the system to reward the player for playing over time as well as for completing other game objectives.

Continuing in block 350, the system may award the player a part of his/her personal, player-accumulated jackpot in the form of a reward that is allocated from each of several wagers. A player may receive multiple personal awards during a single session as the player continues to satisfy game sub-goals.

Continuing in decision block 360, if the system determines that the top goal is satisfied, then the system continues at block 370, else the system loops to block 330 to receive more plays and wagers. Completing the top goal usually signifies completion of the game. The player completes the game after satisfying all the defined sub-goals. After completing the top goal and thus completing the game, the player may play again and start a new instance of the game.

Continuing in block 370, the system distributes a completion award to the player for completing the game. The completion award may be either one reward or many rewards coming from both sub goals and top goals.

Continuing in block 380, the system ends the game after the top goal is complete. After the game is complete, the player may be invited to play again. Achievements can be displayed to other players. After block 380, these steps conclude.

From the foregoing, it will be appreciated that specific embodiments of the gaming reward system have been described herein for purposes of illustration, but that various modifications may be made without deviating from the spirit and scope of the invention. Accordingly, the invention is not limited except as by the appended claims.

We claim:

1. A computer-implemented method to handle one or more plays in the context of a game associated with a player, the method comprising:

identifying the player playing the game;

establishing a game session that begins as the player starts playing the game at a current location on a current game machine and ends as the player indicates the game session is over;

receiving a wager for a current turn from the player, wherein the wager represents the player's estimation of the player's likelihood of success during the current turn;

allocating a first amount from the received wager to operator profit, and a second amount to a player cumulative guaranteed personal jackpot;

incrementing the player cumulative guaranteed personal jackpot based on the second amount allocated to the player cumulative guaranteed personal jackpot;

detecting that a triggering event has occurred, wherein the triggering event ensures the player to win at regular predefined intervals and wherein the player is certain to get a minimum reward for achieving a specific goal, wherein achieving the goal is guaranteed in an average time and challenges the player to get the reward; and as a result of detecting that the triggering event has occurred, awarding the cumulative guaranteed personal jackpot to the player in a manner that only the player who fills the player cumulative guaranteed personal jackpot can trigger the player cumulative guaranteed personal jackpot, wherein the preceding steps are performed by at least one processor.

2. The method of claim 1 wherein identifying the player comprises receiving login information that identifies the player and allows the system to access an associated player profile with information stored about the player across multiple game sessions.

3. The method of claim 1 wherein identifying the player comprises detecting that the player swiped a game playing card at a game machine.

4. The method of claim 1 wherein identifying the player comprises receiving biometric information that identifies the player.

5. The method of claim 1 wherein establishing the game session comprises ending the game session after the player logs off the game machine.

6. The method of claim 1 wherein receiving the wager comprises automatically deducting the wager from an account associated with the player.

7. The method of claim 1 wherein receiving the wager comprises calculating and tracking an average wager amount for multiple turns during the game session.

8. The method of claim 1 wherein allocating the amount from the received wager comprises setting the player cumulative guaranteed personal jackpot to an amount that provides an encouragement to the player to continue playing the current session.

9. The method of claim 1 wherein incrementing the player cumulative guaranteed personal jackpot comprises accumulating the player cumulative guaranteed personal jackpot until one or more conditions for the player cumulative guaranteed personal jackpot's distribution occurs.

10. The method of claim 1 wherein detecting that a triggering event has occurred comprises detecting passage of a threshold period after which the player is rewarded for continuing to play the game.

11. The method of claim 1 wherein awarding the player cumulative guaranteed personal jackpot comprises crediting an account associated with the player.

12. A computer system for providing a guaranteed progressive jackpot in a game, the system comprising:

a processor and memory configured to execute software instructions embodied within the following components;

a player identity component that identifies a player playing the game;

a game session component that manages a particular instance of the player playing the game;

a bet receiving component that receives a wager on a particular play of the game from the player;

a bet allocating component that divides the received wager into (1) operator profit, (2) a small winning amount for the player, and (3) a jackpot amount;

a progressive jackpot component that manages a guaranteed progressive jackpot that is contributed to and won by a single player;

a trigger detection component that detects a triggering event for distributing the guaranteed progressive jackpot to the player, wherein the triggering event ensures the player to win at regular predefined intervals and wherein the player is certain to get a minimum reward for achieving a specific goal, wherein achieving the goal is guaranteed in an average time and challenges the player to get the reward; and a jackpot reward component that distributes the guaranteed progressive jackpot to the player.

13. The system of claim 12 wherein the player identity component maintains a stored user profile for each player to track each player's progress across multiple game sessions and multiple devices.

14. The system of claim 12 wherein the game session component defines a game session as a particular location, machine, and period during which the player is playing the game.

15. The system of claim 12 wherein the bet receiving component receives a wager for each of multiple plays associated with each of multiple goals of the game.

16. The system of claim 12 wherein the bet allocating component allocates as operator profit an amount of money that an operator of the game receives for offering the game to players, and as the guaranteed progressive jackpot an amount won by a single player during the game session.

17. The system of claim 12 wherein the progressive jackpot component is designed so that a player will win at least once and potentially multiple times during a particular game session.

18. The system of claim 12 wherein the trigger detection component defines as a trigger at least one of: passage of time, progress toward sub-goals in the game, lack of wins over a period, and detection of player disinterest.

19. The system of claim 12 wherein the jackpot reward component renders a software-based animation to signal the player that the guaranteed progressive jackpot has been won.

* * * * *